United States Patent [19]

Jovy et al.

[11] Patent Number: 4,510,629

[45] Date of Patent: Apr. 16, 1985

[54] METHOD OF FLUSHING A WATER CLOSET

[75] Inventors: Herbert Jovy, Irschenhausen; Wilhelm Schuster, Frankfurt am Main, both of Fed. Rep. of Germany

[73] Assignee: Ermital AG, Liechtenstein

[21] Appl. No.: 391,499

[22] Filed: Jun. 24, 1982

Related U.S. Application Data

[63] Continuation-in-part of Ser. No. 298,345, Aug. 31, 1981, abandoned.

[30] Foreign Application Priority Data

Mar. 30, 1982 [EP] European Pat. Off. ..... 82102657.2

[51] Int. Cl.[3] ..... E03D 1/24

[52] U.S. Cl. ..... 4/332

[58] Field of Search ..... 4/332, 334, 435, 434, 4/341, 324, 361, 362, 353, 354

[56] References Cited

U.S. PATENT DOCUMENTS

| | | | |
|---|---|---|---|
| 1,293,121 | 2/1919 | Knüsli | 4/334 |
| 1,304,482 | 5/1919 | Hornby | 4/462 |
| 1,850,447 | 3/1932 | Cobb | 4/334 |
| 1,967,680 | 7/1934 | Murphy | 4/332 |
| 2,315,824 | 4/1943 | Sweeny | 4/435 |
| 2,658,203 | 11/1953 | Aue | 4/332 |
| 3,720,962 | 3/1973 | Harrah | 4/435 |
| 4,115,883 | 9/1978 | Dauvergne | 4/353 |
| 4,232,409 | 11/1980 | Van Pham | 4/362 |
| 4,286,342 | 9/1981 | Anthony | 4/434 |

*Primary Examiner*—Henry K. Artis

*Attorney, Agent, or Firm*—Ostrolenk, Faber, Gerb & Soffen

[57] ABSTRACT

A method of and apparatus for flushing a water closet by utilizing water and air for the flushing. The method operates at predetermined pressure ratios. At an air pressure of maximally about 3 bar inside of a pressure vessel the flushing medium consisting of air/water is fed into the pressure vessel, and if the pressure exceeds 3 bar, water only is fed into the pressure vessel. In order to feed water and air a water-jet injection is used which on the one hand communicates via an infeed line with the water mains and on the other hand communicates via an infeed stub at the suction side with the ambient air. The air/water mixture is fed through an infeed line into the pressure vessel, which infeed line ends in a space of the pressure vessel which is occupied by an air cushion. The relative pressures allows a two step flushing which is governed by an accordingly designed discharge valve in the outflow conduit of the pressure vessel.

4 Claims, 5 Drawing Figures

METHOD OF FLUSHING A WATER CLOSET

CROSS REFERENCE TO RELATED APPLICATION

This is a continuation-in-part of Ser. No. 298,345 filed Aug. 31, 1981 and now abandoned.

BACKGROUND OF THE INVENTION

1. Field of the Invention

The present invention relates to a method of flushing a water closet by feeding water and air from a pressure vessel through an outflow valve and an outflow conduit into a toilet bowl.

It also relates to flushing apparatuses for water closets of the kind including a container for the storage of flushing water, which container is provided with an infeed line intended for connection to water main such to communicate said container with the water main, which container is provided further with an outlet line leading to the bowl of said water closet, in which outlet line there is provided a flushing valve which in its opened position establishes communication between said container and said water closet bowl.

2. Description of the Prior Art

Such flushing apparatuses for water closets are commonly known. The water intended for flushing is stored thereby in an open container usually covered by a removable cover for esthetic reasons. The arrangement of so-called low mounted flushing containers, which containers are mounted at the height immediately above the water closet bowl and are connected with a short elbow pipe to the inlet of this water closet bowl, is generally known. Also known is the somewhat older arrangement having a container mounted relatively high above the water closet bowl, i.e. at a vertical distance from 1.20 meters to 1.50 meters above the water closet bowl. Such high hanging containers are connected by the agency of a flushing line including an inlet elbow to the water closet bowl. The flushing water stemming from the water mains of e.g. the community waterworks is stored in these containers and in order to flush the water closet the container is emptied into the bowl thereof. The flushing pressure is governed by the static height of the stored water and is comparatively low. Conclusively, the distribution effect of the water jet in the bowl is quite small. In order to secure a hygenic operation large water quantities are needed in the range of between 9 liters and 14 liters per flushing process depending on the prevailing flushing apparatus installed. Water storage containers located high above the water closet bowl lead to a higher kinetic energy of the water and thus their water consumption is 10% to 15% lower than such of above mentioned low mounted water containers. However, such high hanging water containers result in higher investment costs when installing the flushing line and are hardly used any longer due to esthetic considerations.

In order to provide an adequate volume of water during the short time span as needed during flushing of the water closet all such flushing apparatuses having water storage containers must be provided with large pipe cross sections at their outlet portion. Furthermore, in order to control the filling of the water storage container a mechanism including a float is necessary. This leads to the fact that water closets having such flushing water storage containers incorporate comparatively intrinsic designs. A further drawback of these known systems is their long time span needed for refilling the storage container, namely a time span of about 70 seconds, which does not allow a fast repetitious flushing of the water closet. Furthermore, the volume flow of the flushing water can usually not be controlled. Due to the necessary and known designs the water storage container is practically completely emptied at every flushing procedure, which adds together with the small pressure of the water jet to the extremely high water consumption.

So-called pressure flushing apparatuses have been known since a considerable time, which pressure flushing apparatuses are directly coupled to a water main without a container arranged between the water closet bowl and the water mains and thus flush the water closet at the total line pressure of about 4.5 bar. These flushing apparatuses generate a high water speed and accordingly a satisfactory distribution of the water jet. The water volume used for each flushing procedure can be controlled to a large extent and accordingly may be held at a low volume.

These pressure flushing apparatuses feature, however, the drawback in that in order to secure a large water volume flowing with high speed all infeed lines must comprise cross-sectional areas of the pipes which exceed considerably the standard cross-sectional areas of water pipes.

A more serious problem is the fact that when operating a pressure flushing apparatus sudden pressure changes are generated and transmitted within the complete water pipe network. This follows from the direct connection of the pressure flushing apparatus into the water main net and because water is used as pressure medium. When opening the valve of the pressure flushing apparatus a sudden pressure drop is generated and when closing the flushing valve a sudden increase of pressure is generated. These pressure changes are transmitted shock-wavelike throughout the water column. This leads to a large mechanical stress of the water pipes, which may lead specifically at older pipes rather easily to pipe ruptures.

In the DE-PS No. 108 131 there is disclosed a flushing apparatus mounted in the floor under a toilet bowl and operating during the flushing step by utilizing air as pressurized medium. An air pressure vessel is mounted in the floor and is provided with an upwards leading long pipe for the flushing water, which pipe opens into the toilet bowl. The efficiency of this flushing apparatus is, however, quite insufficient because the air pressure in the air pressure vessel must act against a large water column and, therefore, can generate a small output only.

The DE-GM No. 1 934 598 discloses a flushing apparatus which operates on an injector basis, too. This flushing apparatus aspirates ambient air directly from the flushing pipe. An upright cylindrical container is provided for the storage of the flushing water and an air cushion space is provided above the flushing water. The injector itself is arranged within the flushing water and consists basically of a block having a through bore which extends axially relative to the axis of the container, which through bore feeds water and air into the inner space of the container. The middle section of the axial bore in the block has a restricted cross section and this restricted part is connected via a thin channel to an air aspirating bore. As mentioned above, this aspirating bore extends via a connecting conduit into the flushing pipe. However, such an injector will also not operate satisfactorily. The stream of air drawn is accelerated by the restriction to a multiple speed of flow; however, in the immediately following section of the axial bore having a growing diameter it is decelerated and flows from this point into the flushing water, in which it must work against the pressure of the water column. If now, during flushing, outflowing water generates a resistance, the injector will be practically inoperable. Because, furthermore, the aspiration bore in the air infeed communicates with the flushing pipe, water only is initially transported upon opening of the flushing valve. Accordingly, the injector does initially draw practically no air, but rather merely water out of the aspirating bore which communicates with the flushing or discharge, respectively, pipe. Air is transported only after the flushing water has completely flown into the toilet bowl and the flushing valve was closed. This follows, however, in that during the time span of highest operational conditions the injector cannot draw or aspirate, respectively, any air. Accordingly, the flushing operation is not improved in spite of a high water consumption and of a design which due to the through bores is relatively complicated and additionally trouble prone. The ball valves used do not always ensure a safe seal and the injector which is mounted in the container is accessible with difficulties only, which obviously leads to difficulties in the maintenance of the apparatus.

SUMMARY OF THE INVENTION

Hence, it is a general object of the present invention to provide a method of flushing a water closet with air and water and leads to an optimal flushing with a minimal expenditure of water.

Another object of this invention aims at the provision of a new and improved construction of a flushing apparatus for water closets, which has minimal dimensions, is extremely simple in construction and design, reliable in operation and easy to install.

Now, in order to implement these and still further objects of the invention, which will become more readily apparent as the description proceeds, the method of this development comprises the feeding of air and water at a pressure within the pressure vessel of maximal about 3 bar and the feeding of water only at a pressure higher than about 3 bar into a pressure cushion space of the pressure vessel.

By means of the method according to the present invention the operation is carried out at well chosen relative pressures such that the operation ceases not earlier than at a pressure of about 2.8 bar. Up to this pressure air is continuously fed whereby this operation proceeds in the free air cushion space and at no time against a water column. This leads to an excellent feeding of air. When the pressure resistance approaches the value zero, i.e. when the air feeding action is the largest, a larger amount of air than water is transported. This is extremely important regarding the flushing. As soon as the final water quantity is pressed out of the pressure vessel, water and air are transported in a relative amount of 1 to 1.3 up to 1.5. This means that in order to support the flushing action by the final flow of water, which has more than doubled its volume by the high portion of air, a highly accelerated water/air column is flushed into the toilet bowl. Because of the high speed the water/air column features a high kinetic energy such that the final flushing is decisively improved. With this operation it is possible to achieve an optimal flushing with minimal amounts of water, and because in accordance with the invention air is fed in a larger amount than water, the flushing proceeds practically with a larger amount of air than water. It is now possible to flush with the total pressure of the water mains. All these factors aid to a minimizing of the water necessary for flushing. Accordingly, the pressure vessel forming the water storage container can be kept at comparably small dimensions such that, additionally, short refilling times are needed after a flushing operation. The operation allows a true, effective two-step flushing, whereby a first step is a partial flushing and a second step is a complete flushing.

The structural members of the inventive apparatus are relatively simple and easily accessible because they are not located within the pressure vessel. The flushing apparatus is separated by the intermediately located pressure vessel from the water mains, and the pressure prevailing within the pressure vessel is the same as the pressure which prevails in the water mains. This air forms an elastically yielding pressure cushion and can take up sudden pressure rises. Accordingly, detrimental back-effects into the water mains cannot be generated. Because of its design as pressure vessel the water container can be arranged in practically any position relative to the toilet bowl and may be given any shape such that it is possible to construct extremely compact apparatuses.

BRIEF DESCRIPTION OF THE DRAWINGS

The present invention will be more fully understood by reference to the following detailed description thereof, when read in conjunction with the attached drawings, and wherein.

DETAILED DESCRIPTION OF THE PREFERRED EMBODIMENT

Figure 1:
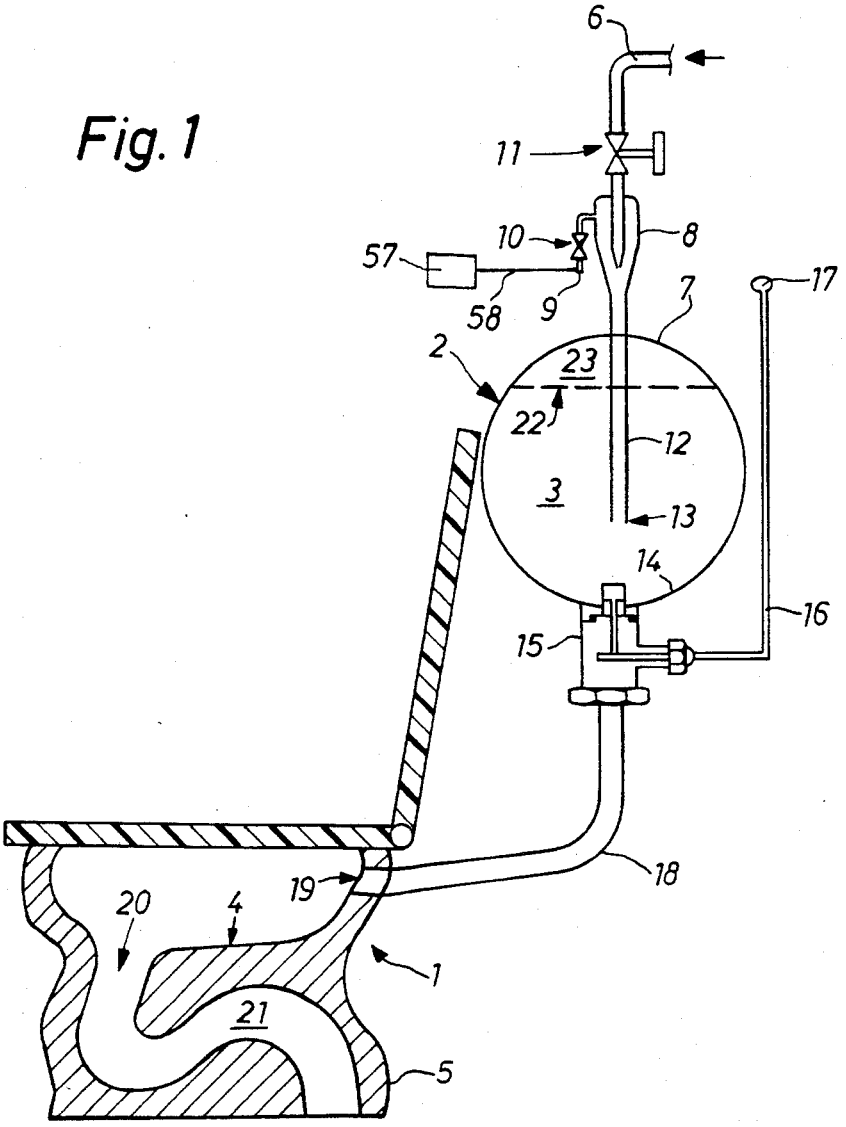
FIG. 1 is a side view of a preferred embodiment of the inventive flushing apparatus, partly shown in section.
Figure 3:
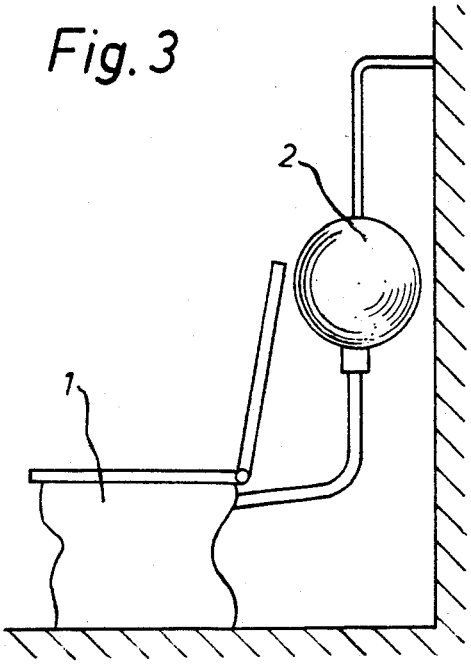
FIGS. 3 to 5 show embodiments of the pressure vessel having various shapes and installed at various locations.
Figure 4:
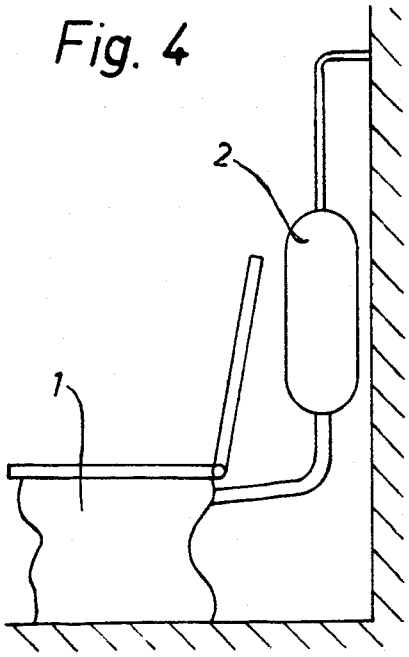
Figure 5:
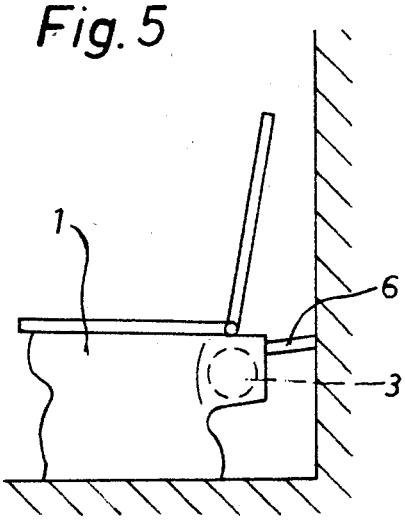

Describing now the drawings and considering initially the embodiment as shown in FIG. 1 it will be understood that same comprises a water closet 1 provided with a preferred embodiment of the inventive flushing apparatus. Such includes an enclosed pressure vessel 2 intended to contain and store flushing water 3, above of which there is located the air cushion 23. According to the preferred embodiment as shown in FIG. 1 this pressure vessel 2 is provided in the form of a sphere and arranged somewhat above the water closet bowl 4. It is to be understood that any other design and location of this pressure vessel 2 is conceivable and possible. Specifically, the pressure vessel 2 may be designed in form of an elongated cylindrical vessel and be placed adjacent the heel portion 5 of the water closet 1 below the bowl 4 of the water closet. Further shapes are shown in FIGS. 3 to 5 and will be described later.

The fresh water is fed into the pressure vessel 2 through an infeed line 6, which enters the pressure vessel 2 at its top side 7, i.e. into the air cushion space. An injector 8 is mounted in the infeed line 6, through which injector 8 air flows together with the inflowing water into the pressure vessel 2. The injector 8 is basically a conventional water jet pump of known design whereby its suction line 9 communicates with the ambient air whereby a check valve 10 is mounted in this suction line 9. The water flowing through this injector 8 and into the pressure vessel 2 generates thereby at the suction line 9 a vacuum, through which the check valve 10 will be opened. Accordingly, air is aspirated into the injector 8, which air mixes with the flowing water and accordingly is transported via an air-water infeed 6' into the pressure vessel 2. If the pressure vessel gets filled up and the water flow in the injector 8 decreases, the vacuum is released and accordingly the check valve 10 will be closed. This avoids water flowing from the injector through the suction line 9 to flow in reverse direction into the ambient.

It is possible to mix disinfecting and/or air refreshing substances with the air flowing into the injector 8. If such design is chosen, corresponding storage means 57 are located at the suction line 9 of the injector 8 whereby mentioned substances are aspirated via feed line 58.

At a location above the injector 8 a shutoff valve 11 is mounted in the infeed line 6 allowing the water closet 1 to be separated from the water mains during installation or repiar work. Such shutoff valves 11 are generally known in conjunction with water closets and thus there is no need for a separate description thereof.

The infeed line 6 leads into the air cushion space at the top side 7 of the pressure vessel 2. A flushing valve 15 is mounted preferably at the lowermost area of the pressure vessel 2, which flushing valve 15 is operated for introducing the flushing proper. To this end there is provided an arm 16, which can be gripped at a knob 17 and pushed down therewith. Structural details of this flushing valve 15 will be explained further below.

An outlet elbow 18 connects the flushing valve 15 with the water closet 1. This outlet elbow 18 ends at a location above the bowl 4 of the water closet at an opening 19, such that the water jet exiting out of the opening 19 flushes any matter located in the bowl 4 into a discharge 20. The discharge 20 is connected via a pipe 21 (siphon) to the waste water or sewer, respectively, system in a known way.

The operation steps of the inventive flushing apparatus are as follows. After having flushed the water closet the pressure vessel 2 will be empty or only partially filled, respectively. The pressure vessel 2 contains a residual volume of water and air at atmospheric pressure (1 bar). Due to the water pressure of the water mains, which water pressure exists also in the infeed line 6 and has a value of about 4.5 bar (standard pressure), water is pressed through the injector 8 into the pressure vessel 2. As soon as a vacuum builds up at the suction line 9 of the injector 8, the check valve 10 will be opened. Air from the ambient is aspirated, which air mixes with the inflowing water and which is transported into the pressure vessel 2 in addition to the air already present in the pressure vessel 2 as mentioned above. The mixture of air and water as formed in the injector 8 separates after its entry into the pressure vessel 2, whereby the air in the pressure vessel bubbles against its top side.

Air and water are fed into the pressure vessel 2 until the pressure within the vessel has risen to maximal about 3 bar. If this internal pressure rises further, i.e. above about 3 bar, water only is fed. The air contained and retained in the pressure vessel 2 will now be compressed due to the rising water level or column, respectively, in the pressure vessel 2. Accordingly, the difference between the line pressure prevailing in the infeed line 6 and the air pressure prevailing in the pressure vessel 2 decreases. This follows in that the water flow to the injector 8 slows down and diminishes such that its suction or aspiration, respectively, action diminishes, too. Finally, the vacuum at the suction line 9 of the injector 8 breaks down such that the check valve 10 closes. Thereafter water will flow through the infeed line 6 and through the injector 8 at a slow speed until the complete pressure equalization is reached. Accordingly, the air cushion 23 forms above the water level 22 in the pressure vessel 2, which air cushion 23 is pressurized to a value corresponding to the total pressure of the water mains. Changes of the pressure of the water mains will be taken up by changes of the level height of the water level 22. Thereby the enclosed volume of air will be retained inside the pressure vessel 2 arbitrarily long until a flushing is initiated.

In order to initiate the flushing valve 15 located at the bottom 14 of the pressure vessel 2 is opened. The pressure shock waves generated when operating this valve will be taken up by the compressible air cushion 23 in the pressure vessel 2 and and accordingly they will not be transmitted to the water mains. The flushing water 3 contained in the pressure vessel 2 will be accelerated due to the pressure of the air cushion 23 and transported via the outlet elbow 18 into the water closet 1. Thereby a high flowing speed and an excellent distributing action of the flushing water is achieved. As soon as a pressure drop begins to form in the pressure vessel 2, water will be fed in via the infeed line 6 and as soon as a large enough flowing speed of the water is reached, the injector will come again in operation. Preferably the flushing valve 15 will not close until a considerable amount of the water-air mixture has flowed again into the pressure vessel 2 and flowed out of the flushing valve 15 because in accordance with practical test runs made at an embodiment of the present invention said air-water mixture leads to an excellent flushing action.

Figure 2:
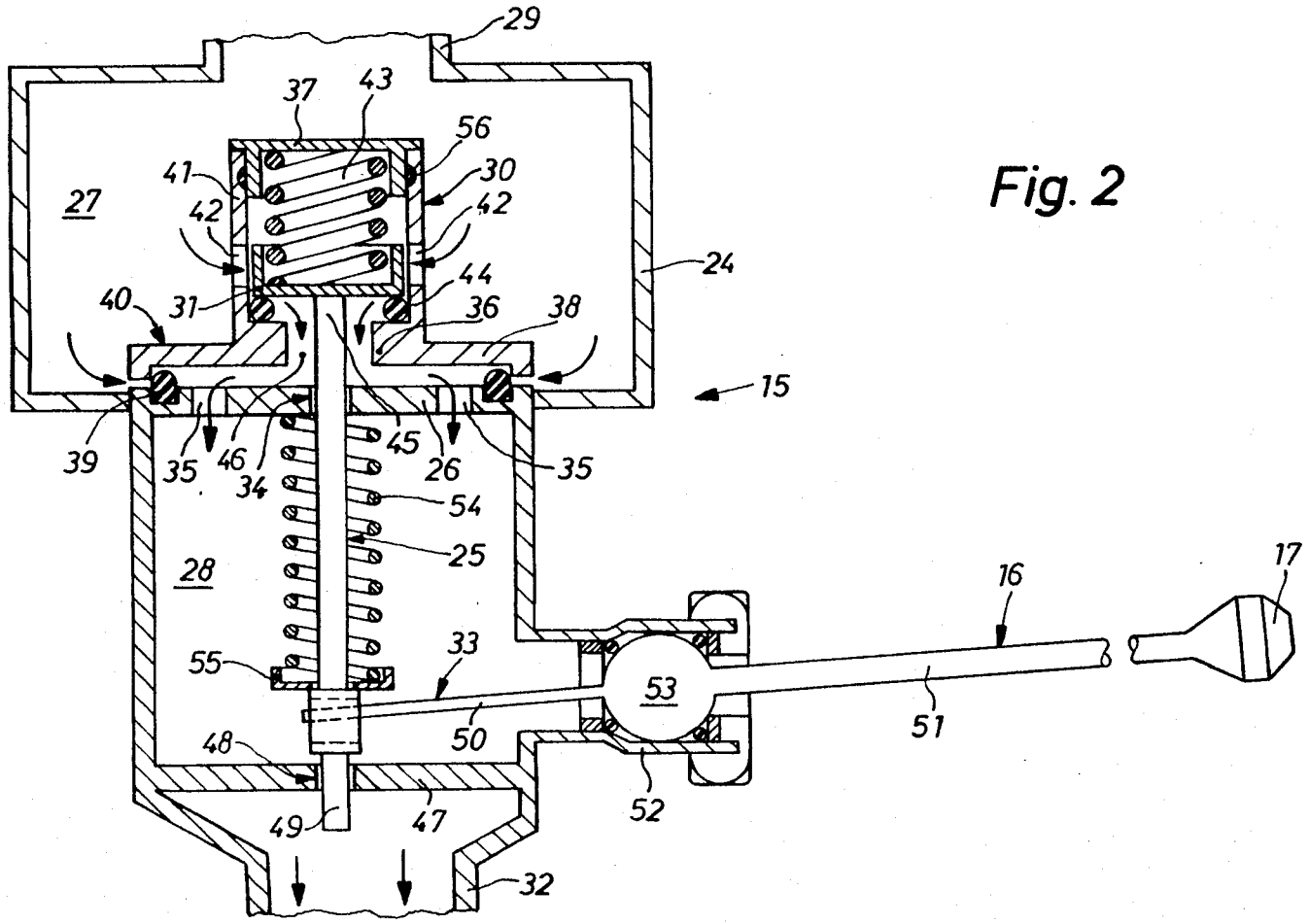
FIG. 2 is a view of a section of a discharge valve of the flushing apparatus shown in FIG. 1.

A preferred embodiment of a flushing valve 15 is shown in FIG. 2. This flushing valve 15 allows to control the amount of flushing water in two operating modes. It is thereby possible to carry out by utilizing only a part of the flushing water 3 stored in the pressure vessel 2 a partial flushing. On the other hand, it is possible to carry out a complete flushing at a practically complete emptying of the pressure vessel 2. Thereby it is possible to carry out the complete flushing mode immediately or not earlier than after having carried out a preceding partial flushing.

The flushing valve 15 comprises an axial symmetric casing 24 along the central axis of which there extends a piston rod 25. The casing 24 is divided by a partition 26 in two chambers 27, 28. The first chamber 27, which is shown in FIG. 2 as the upper chamber, is arranged at the water inlet side of valve 15. This upper chamber 27 is provided with a pipe stub 29 acting as infeed to the valve and comprises a valve cap 30 and a sealing rod sleeve 31 arranged within this valve cap 30, whereby the valve cap 30 and this sealing rod sleeve 31 are operated both by the piston rod 25. The second chamber shown in FIG. 2 as the lower chamber is arranged at the water outlet side of the flushing valve 15. This lower chamber carries a corresponding pipe stub 32 acting as valve discharge and contains a mechanism 33 for operating mentioned piston rod 25.

The partition 26 comprises a central bore 34, through which bore 34 the piston rod 25 extends. Further openings 35 are arranged in the partition 26 such to allow water to flow from the upper chamber 27 into the lower chamber 28 such as is the case by the aforementioned central bore 34. This through flow is shut off in the closed position of valve 15 by the valve cap 30 and the sealing rod sleeve 31.

The valve cap 30 is a hollow cylinder having a bottom wall 36 protruding radially inwards at the lower end of the hollow cylinder. The valve cap 30 is provided furthermore with a cover 37 rigidly connected thereto. The bottom wall 36 is integrally formed with an edge section 38 extending radially outwards relative to the valve cap 30. By agency of this edge section 38 the valve cap 30 engages sealingly the partition 26. An elastomeric ring 39 inserted in the partition 26 acts as sealing means and as guide of mentioned edge section 38, which sealing ring 39 encloses the opening 35 arranged in the partition 26. The valve cap 30 is held onto the elastomeric ring 39 by agency of the water pressure prevailing in the upper chamber 27. The water pressure acts thereby onto the upper surface 40 of the edge section 38 as well as of the cover 37, which closes the valve cap 30 on its upper side.

The side wall 41 of the valve cap 30 is provided with through bores 42, through which bores 42 water may flow into the inner space of the valve cap 30. A further flow of the water is shut off by the sealing rod sleeve 31. This sealing rod sleeve 31 is axially movable and guided within the valve cap 30 and bears against a pressure spring 43 which in turn bears against the cover 37 of the valve cap 30. The sealing rod sleeve 31 rests sealingly on a O-ring 44 supported by the bottom wall 36 of the valve cap 30. The sealing rod sleeve 31 is held in the sealing position as shown in FIG. 2 by the action of the force of the pressure spring 43 as well as by the action of the water pressure in the upper chamber 27 present within the valve cap 30.

The piston rod 25 is mounted at one end 45 rigidly to the sealing rod sleeve 31. This piston rod 25 projects through a central opening 46 formed in the bottom wall 36 of the valve cap 30. The space around the piston rod 25, i.e. the annulus defined by the inner wall of the central opening 46 and the outer wall of the piston wall 25 forms a flow channel for water flowing in through the through bores 42 formed in the side wall 41 of the valve cap 30. The piston rod 25 is guided in the central bore 34 of the partition 26 and by a plate 47 arranged in the lower chamber 28. The plate 47 is provided with a central bore 48, through which a plug 49 formed integrally and coaxially to the piston rod 25 projects. The movement of the piston rod 25 in axial direction is initiated by the mechanism 33. This mechanism 33 comprises basically a lever arm 16 having a further lever 50 hingedly connected to the piston rod 25 and extending roughly at a right angle thereto. A further lever 51 projects through a pipe stub 52 of the casing 25 towards the outside and is sealed within pipe stub 52. A hinge arrangement 53 is provided inside the pipe stub 52 allowing the lever arm 16 to be rotated upon a manually initiated downward movement of knob 17. This rotary movement of lever 16 follows obviously in an axially directed upwards movement of piston rod 25 such to initiate the flushing.

Mentioned axial movement of piston rod 25 proceeds against the force of a resetting spring 54. This resetting spring 54 surrounds helically the piston rod 25 and is located within the lower chamber 28. The spring 54 bears on one side against the partition 26 and at the other side against a plate 55 rigidly connected to a lower end section of piston rod 25.

Accordingly, the axial movement of the piston rod 25 including the sealing rod sleeve 31 is subject to a double spring action, namely, firstly, the spring action of the pressure spring 43 and secondly, the spring action of the resetting spring 54. The movement of the piston rod 25 initiating the flushing leads to a compressing of both springs 43, 54. The axial movement of the sealing rod sleeve 31 is limited by an abutment arrangement. Thereby a sleeve 56 acts as an abutment, which sleeve 56 is formed at the cover 37 of the valve cap 30 and projects into the inner space of valve cap 30.

This flushing valve 15 allows now two flushing modes, i.e. it allows a controlling of the amount of flushing water in two steps. The partial flushing mode is initiated by pressing lever 16 downwards by a relatively small amount. The corresponding short axial movement of the piston rod 25 leads to a lifting off of the sealing rod sleeve 31 from the O-ring 44, whereby the sealing rod sleeve 31 does not reach the abutment position in which it contacts sleeve 56. Accordingly, water is free to flow through the through bores 42 of the side wall 41 of the valve cap 30, through the central opening 46 as well as the openings 35 of the partition 26. Thereby the forces of both compressed springs 43 and 54, pressure prevailing in the upper chamber 27 as well as a flow pressure act combined on the sealing rod sleeve 31. These pressure forces hold this sealing rod sleeve 31 against the combined forces of springs 43 and 54 in its open position until the pressure vessel 2 has been emptied by a certain amount and the pressure has fallen accordingly. Thereafter, the sealing rod sleeve 31 is reset by the pressure spring 43 and by the resetting spring 54 such to move again in its sealing position.

The complete flushing mode can be initiated by operating the flushing valve 15, either immediately or with a delay. In order to initiate the immediate complete flushing lever arm 16 is pushed down completely. Thereby again piston rod 25 moves axially and accordingly the sealing rod sleeve 31 is moved axially following in a large compressing of pressure spring 43. Thereby the sealing rod sleeve 31 will move upwards until it abuts and contacts sleeve 56 and moves further upwards taking sleeve 56 along. This continued upward movement of sleeve 56 causes obviously a lifting off movement of valve cap 30 from its sealing position on ring 39. This leads to the forming of a large annular slot between valve cap 30 and partition 26, such that an additional large volume flow of water flows therethrough. The flow pressure resulting thereof holds the valve cap 30 in its lifted-off position so long until the pressure vessel 2 is emptied practically completely. Thereafter, valve cap 30 as well as sealing rod sleeve 31 are reset to their sealing position whereby the resetting movement of the valve cap 30 proceeds under influence of the force of the resetting spring 54 and the movement of the sealing rod sleeve 31 proceeds under the combined action of pressure spring 43 and resetting spring 54.

The delayed complete flushing mode proceeds as follows. By a slight downwards movement of arm 16 initially a partial flushing is initiated and lever arm 16 is held in this position. Accordingly, only the sealing rod sleeve 31 is moved upwards into its open position allowing above explained partial flushing mode. During this partial flushing water flows out of the pressure vessel 2 and the pressure prevailing in the upper chamber 27 decreases. The automatic resetting and closing off of the sealing rod sleeve 31 as mentioned above and which would proceed automatically is, however, prevented in that the lever 16 is manually held in its slightly rotated position. This manual holding or arresting, respectively, of lever 16 results obviously that the pressure spring 43 is held somewhat compressed. Along with the decrease of the pressure prevailing in the upper chamber 27 the force acting onto the valve cap 30 generated by this pressure decreases until this force is smaller than the force exerted by the pressure spring 43. Accordingly, the valve cap 30 is lifted off its sealing seat by action of the pressure spring 43 and the complete flushing mode begins automatically.

The above described and shown embodiment of the flushing valve 15 allows a sudden complete flushing as well as the delayed complete flushing. This arrangement is, however, not mandatory. If the water main pressure is extremely high and the diameter of the corresponding pipes too small, a sudden or not delayed, respectively, complete flushing could lead to exceedingly strong water flows, which may splash, splutter or even splash out of the bowl 4 of the water closet. In such cases it is necessary to prevent a sudden complete flushing. This can be made in a known way by a suitable limitation of the stroke of the piston rod 25 (not particularly shown), which allows only an initial partial flushing or a delayed full flushing. Such a limitation of the stroke can also be of interest regarding a small water consumption because such leads always to a preceding partial flushing.

The pressure vessel 2 may have various shapes and may be mounted at various locations because its operation proceeds independently of the forces of gravity. According to the embodiment of FIG. 1 the pressure vessel is given a spherical shape and is mounted somewhat above the water closet 1, such as schematically shown in FIG. 3. The pressure vessel 3 which according to FIG. 3 is located above the water closet 1 may, however, be a cylindrical vessel whereby the center axis of such cylinder according to FIG. 3 may extend horizontally. This shape allows specifically a simple mounting at an existing toilet. FIG. 5 depicts an embodiment, in which the complete pressure vessel 2 is mounted within the ceramic portion of the water closet 1, i.e. it is not visible from the outside. Also in this embodiment the pressure vessel 2 may be of spherical or cylindrical configuration. Because, however, the pressure vessel is not restricted to any specific shape, it may be designed in accordance with the particular shape of the water closet 1, it may, for instance, describe the shape of a portion of a toroid. Besides aesthetical considerations an arrangement in accordance with FIG. 5 is a specifically compact and space saving design. Further, the water infeed pipe 6 is extremely short and thus hardly visible which leads to a clean appearance and a cost-saving mounting because now no elbow pieces are necessary.

It is possible to achieve an excellent flushing action at a minimal water consumption. This is achieved basically because the flushing water flows with a water pressure as high as the water pressure prevailing in the water mains. Conclusively, the water consumption is as low as is the case at the known pressure flushing apparatuses. The described flushing valve allows, moreover, a dosing of these water volumes for a partial flushing, a sudden or delayed full flushing of the water closet such that the mean water consumption is lowered further.

Technical data of a preferred embodiment of the inventive flushing apparatus are as follows: The capacity of the pressure vessel is about 5 liters. The pumping or flow, respectively, output of the injector at a water main pressure of 4.5 bar and completely opened valve is 15 liters/air per minute and 11.5 liters/water per minute. A suction action of the injection takes place by a pressure within the pressure vessel of less than 2.8 bar. The flushing time span for a partial flushing is 2 seconds and for a complete or full, respectively, flushing 3 seconds. The time for a refilling of the pressure vessel is 22 seconds.

Measurements have disclosed that the noise generation of the inventive flushing apparatus is comparable or lower than is the case by other systems. A test model generated a maximal noise level of 103 db compared with 108 db for a common pressure flushing apparatus and 104 db for a flushing apparatus having an open water storage container. It must be mentioned thereby that it would have been possible to provide a much stronger noise attenuation equipment at the inventive flushing apparatus such that the noise generation could be lowered still more.

While there are shown and described present preferred embodiments of the invention, it is to be distinctly understood that the invention is not limited thereto, but may be otherwise variously embodied and practiced within the scope of the following claims.

Accordingly, what is claimed is:

1. A method of flushing a water closet by simultaneously feeding water and air from a pressure vessel into a toilet bowl, comprising the steps of filling the pressure vessel by discharging a jet of water at elevated pressure into the pressure vessel and causing the jet of water to aspirate air to deliver a larger amount of air than water air at elevated pressure into the pressure vessel; continuing the discharging of the jet of water to obtain a pressure within the pressure vessel of the order of three atmospheres; forming a pressure cushion of air in the pressure vessel above the water, where the feeding of water only at a water pressure higher than about three atmospheres into the pressure cushion space of the pressure vessel and initiating a flushing valve to thereby release the combined pressurized air/water medium to affect a highly accelerated water/air column whereby more air is employed in the flushing action.

2. The method of claim 1, wherein at a pressure within the pressure vessel of less than about 2.2 atmospheres a larger quantity of air than water is fed into said vessel and upon thereafter maintaining the flow of water and air, feeding a post flushing stream having a high inflow velocity in the toilet bowl.

3. The method of claim 1, wherein during a first step a partial flushing and during a second step a complete flushing is carried out.

4. A method of flushing a water closet by simultaneously feeding pressurized water and air from a pressure vessel through an outflow valve and outflow conduit into a toilet bowl whereby more air than water is delivered into said toilet bowl, comprising the steps of filling the pressure vessel with water and air by means of an injector acting as a water jet pump, and feeding air and water at a pressure within said pressure vessel of maximal about 3 bar and feeding water only at a pressure higher than about 3 bar into a pressure cushion space of said pressure vessel, building up a pressurized air cushion above the water level in said vessel and initiating a flushing valve to thereby release the combined pressurized air/water medium to affect a highly accelerated air/water column whereby more air than water is employed in the flushing action.

* * * * *